United States Patent [19]

Ross

[11] Patent Number: 4,941,802

[45] Date of Patent: Jul. 17, 1990

[54] MULTI-BLADED PROPULSION APPARATUS

[76] Inventor: John C. Ross, 14 Dustan Crescent, Toronto, Ontario, Canada, M4J 4G5

[21] Appl. No.: 360,591

[22] Filed: Jun. 2, 1989

[51] Int. Cl.[5] ..... B63H 3/02

[52] U.S. Cl. ..... 416/164; 440/50

[58] Field of Search ..... 416/177, 164, 189 R, 416/132 R, 132 A; 415/91, 124.1; 440/48, 50, 51

[56] References Cited

U.S. PATENT DOCUMENTS

| | | | |
|---|---|---|---|
| 1,326,730 | 12/1919 | Helguera | 416/189 R |
| 1,914,332 | 6/1933 | Smith | 416/207 |
| 2,133,853 | 10/1938 | Feige | 416/177 |
| 2,374,125 | 4/1945 | Peirce | 440/50 X |
| 2,605,606 | 8/1952 | Pilz | 415/124.1 X |
| 2,652,505 | 9/1953 | Matheisel | 415/91 X |
| 3,011,561 | 12/1961 | Wagener | 416/189 R |
| 3,804,553 | 4/1974 | Hickey | 415/91 X |
| 4,648,788 | 3/1987 | Jochum | 415/91 |
| 4,838,819 | 6/1989 | Todorovic | 440/48 X |

FOREIGN PATENT DOCUMENTS

| | | | |
|---|---|---|---|
| 150099 | 7/1987 | Japan | 416/132 A |
| 8201160 | 10/1983 | Netherlands | 416/93 A |
| 28266 | of 1911 | United Kingdom | 416/132 R |
| 234683 | 1/1926 | United Kingdom | 416/177 |
| 514242 | 11/1939 | United Kingdom | 416/189 R |

*Primary Examiner*—John T. Kwon

[57] ABSTRACT

The present invention provides for a propulsion apparatus for fluid medium comprising an open-ended sleeve having an inlet and outlet for flow through of fluid and a series of cooperating blades positioned along the sleeve. Each of the blades has a leading and trailing edge and the blades are fixed to rotate with the sleeve and cause a progressive acceleration of fluid from the inlet to the outlet with rotation of the sleeve thereby providing thrust for propulsion. The blades cooperate to define a fluid path to accelerate a fluid from the inlet to the outlet to thereby provide thrust for propulsion as the sleeve is rotated. The apparatus of the present invention provides forward and reverse speed of propulsion independent of the speed and rotation of the driving mechanism whereby adjustment of the blades at a fixed speed accelerates or decelerates the propulsion effort.

7 Claims, 4 Drawing Sheets

FIG. 1
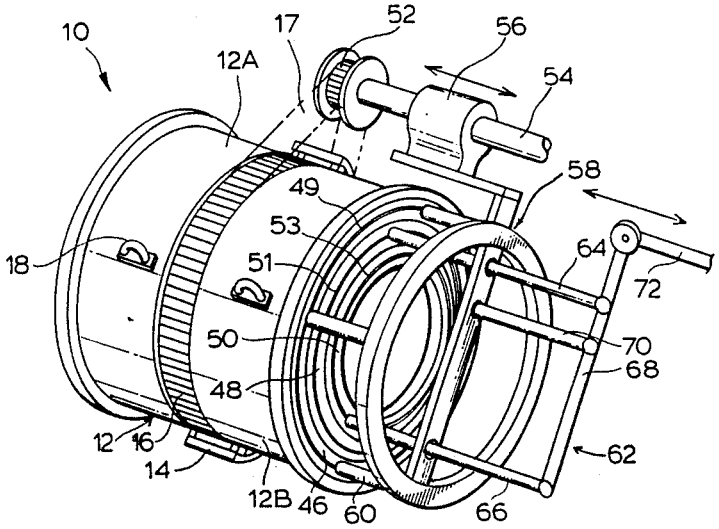
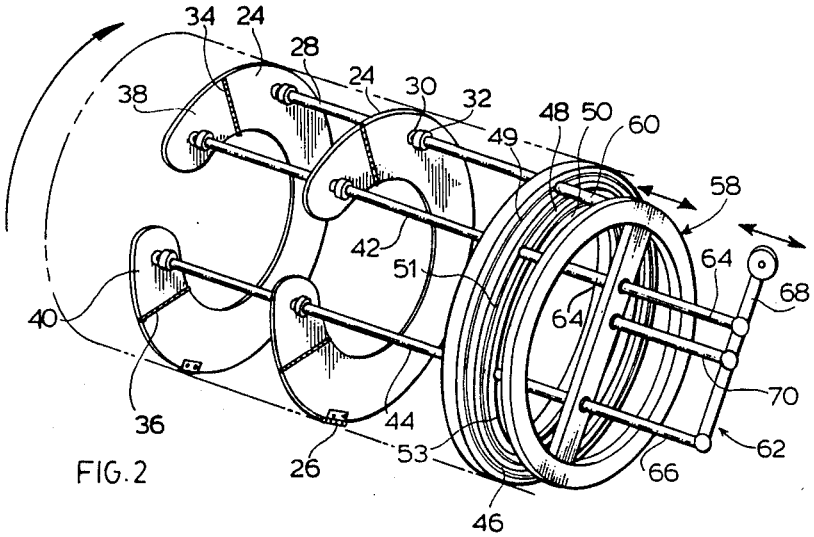
FIG. 2

MULTI-BLADED PROPULSION APPARATUS

FIELD OF THE INVENTION

The present invention relates to multi-bladed propulsion apparatus for use with a fluid. In particular, the apparatus is useful for a liquid medium, particularly as a propulsion apparatus for attachment to marine engines.

BACKGROUND OF THE INVENTION

At the present time, many propulsion apparatus for use with a fluid and in particular, propeller assemblies for use in a liquid medium with marine engines, are constructed of a plurality of axially projecting blades. This conventional design has a number of drawbacks, not the least of which is that if one wishes to vary the direction of the propulsion, i.e. going from forward to reverse, it is necessary to provide a transmission between the motor and the propeller to reverse the rotation of the propeller thereby providing for reverse movement. This direct relationship between the engine and transmission is required to provide proper directional rotation of the propeller for maintenance of forward or reverse speeds and the degree of propeller thrust obtained. Axially mounted propellers when used with marine engines are also very susceptible to fouling up, especially in low draft waters with a weedy bottom and to damage if in contact with hard objects.

There thus remains a need for a propulsion apparatus for fluid medium which reduces the above disadvantages.

The present invention provides for a propulsion apparatus for fluid medium comprising an open-ended sleeve having an inlet and outlet for flow through of fluid and a series of cooperating blades positioned along the sleeve. Each of the blades has a leading and trailing edge and the blades are fixed to rotate with the sleeve and cause a progressive acceleration of fluid from the inlet to the outlet with rotation of the sleeve thereby providing thrust for propulsion. The blades cooperate to define a fluid path to accelerate a fluid from the inlet to the outlet to thereby provide thrust for propulsion as the sleeve is rotated.

In an aspect of the invention, the array of the blades is angularly adjustable to vary the bite of the blades from the perpendicular.

In another aspect of the invention, the leading and trailing edges of the blades are adjustable, thereby varying displacement of the fluid medium by the blades.

In yet another aspect of the invention, the adjustment of the pitch of the leading and trailing edges of the blades, in conjunction with the adjustment of the angular bite of the blade, allows for both forward or reverse thrust without reversal of the direction of the driving mechanism of the apparatus.

The apparatus of the present invention provides forward and reverse speed of propulsion independent of the speed of the driving mechanism whereby adjustment of the blades at a fixed speed accelerates or decelerates the propulsion effort.

BRIEF DESCRIPTION OF THE DRAWINGS

In drawings which illustrate a preferred embodiment of the invention,

FIG. 1 is a perspective view of the propulsion apparatus of the present invention, FIG. 2 is a perspective view of the individual blades and the adjusting means of the embodiment of FIG. 1.

DETAILED DESCRIPTION OF THE PREFERRED EMBODIMENTS OF THE INVENTION

Figure 3:
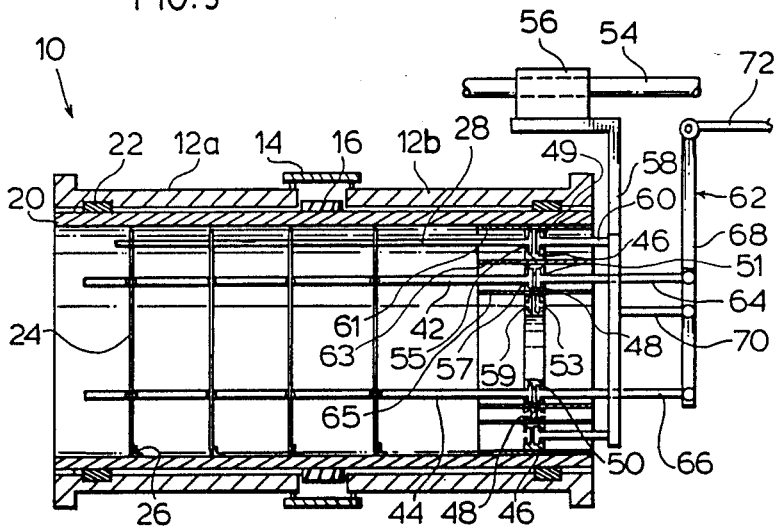
FIG. 3 is a side elevation view in section of the embodiment of FIG. 1 in the neutral position.
Figure 4:
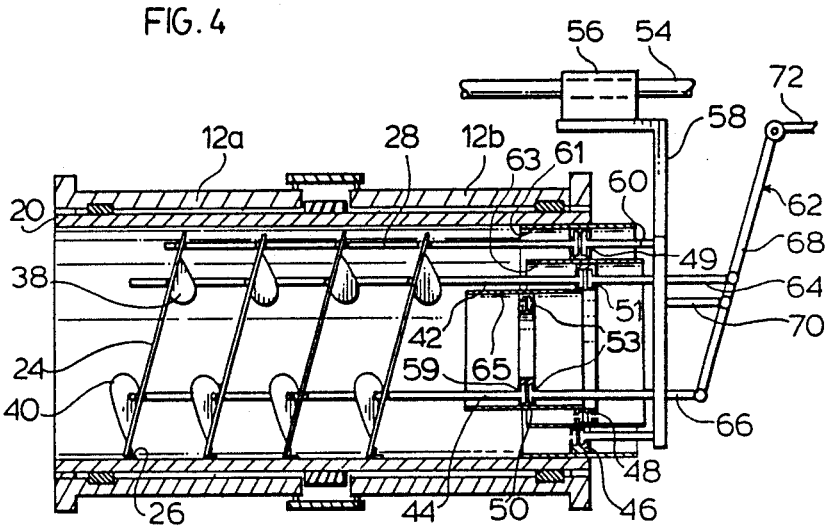
FIG. 4 is a side elevation view in section of the embodiment of FIG. 1 in reverse thrust position.

The propulsion apparatus of the present invention is shown in FIG. 1 generally at 10. The apparatus 10 has an outer casing 12, made up of two hollow cylindrical halves, 12*a* and 12*b*. These two halves 12*a* and 12*b*, are joined together by a bracket assembly 14, which includes space therein for a ring gear 16. Fastening brackets 18 are provided on outer casing 12 for attachment of the apparatus 10 to, for example, a boat (not shown).

As shown in FIG. 3, a sleeve 20 is rotatably mounted within outer casing 12. Sleeve 20 is comprised of a hollow cylinder with ring gear 16 fitted on its external mid-section. Bearings 22 are provided between the outer casing halves 12*a* and 12*b* and the sleeve 20 to permit free rotation of sleeve 20 within outer casing 12. In the embodiment illustrated, bearings 22 are bearing sleeve assemblies, however any of the bearing assemblies known in the art can be employed.

Figure 5:
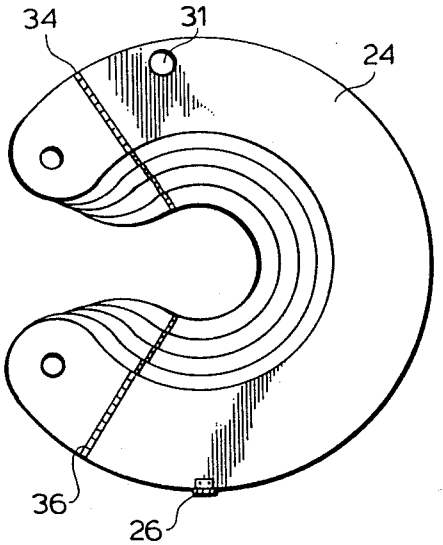
FIG. 5 is a front elevation view of the blades of the embodiment of FIG. 1.
Figure 8:
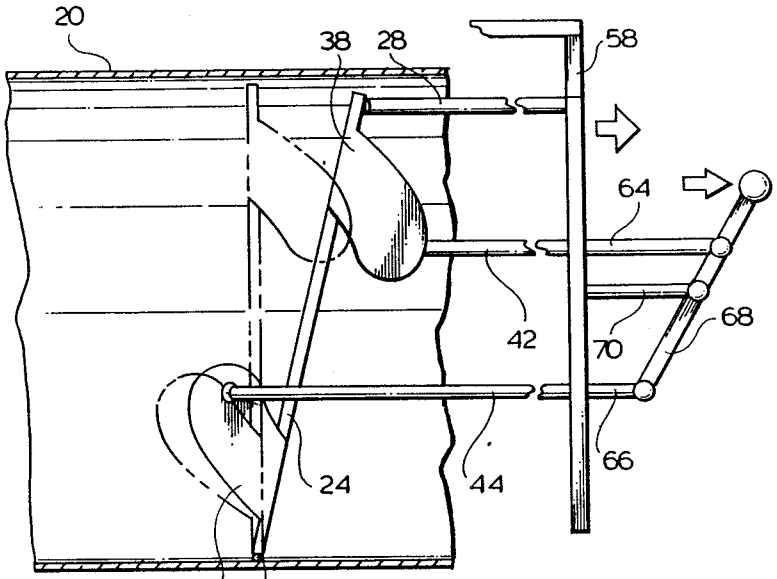
FIG. 8 is a side elevation view of the adjustment of the blades of the embodiment of FIG. 1 for reverse thrust.
Figure 7:
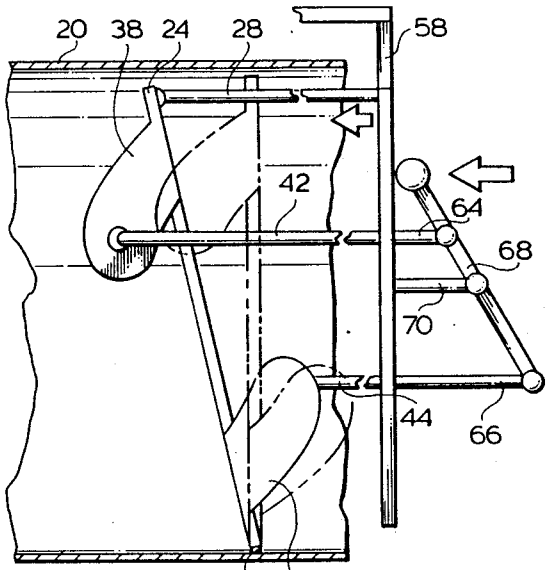
FIG. 7 is a side elevation view of the adjustment of the blades of the embodiment of FIG. 1 for forward thrust.

A series of blades 24 are peripherally mounted within sleeve 20 for rotation therewith. As shown in FIGS. 2 and 5, blades 24 are generally aligned C-shaped blades and are peripherally mounted to sleeve 20 at the bottom of the blades 24 by blade attachment hinges 26. Blades 24 are joined together at the top through a first adjusting rod 28, which passes through openings 30 in blades 24. Blades 24 are held in position on adjusting rod 28 by stoppers 32. Blades 24, at their top and bottom, have internal blade hinges 34 and 36 adjacent the opening of the general C-shape. By means of hinges 34 and 36, sections 38 and 40 of blades 24 are free to pivot about hinges 34 and 36. These sections are called, respectively, leading edge 40 and trailing edge 38 assuming a clockwise rotation of the blades 24. Trailing edges 38 of individual blades 24 are linked together by a second adjusting rod 42 and leading edges 40 are linked together by a third adjusting rod 44 in a manner similar to that for first adjusting rod 28.

First adjusting rod 28, at its one end, is held within a raceway 55 in a first end ring bearing 46 for rotation therewith. Similarly the ends of adjusting rods 42 and 44 are held in a second raceway 57 in a second end ring bearing 48 and a third raceway 59 in a third end ring bearing 50 respectively, for rotation therewith.

Ring gear 16 is attached, either directly through teeth engagement or through a belt drive 17 to drive gear 52 which is mounted upon drive shaft 54. Drive shaft 54 is in turn attached to a suitable driving mechanism, for example a motor means (not shown).

Figure 6:
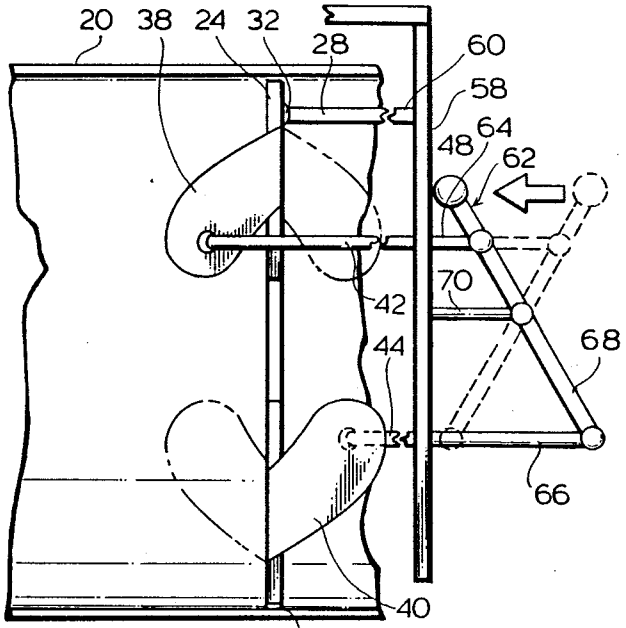
FIG. 6 is a side elevation view of the adjustment of the leading and trailing edges of the individual blades of the embodiment of FIG. 1.

Mounted on drive shaft 54 is a yoke 56 whereby drive shaft 54 rotates freely within yoke 56. Yoke 56 is slideable along drive shaft 54 and is connected to a first adjusting means 58. First adjusting means 58 has fingers 60 extending therefrom which are held in a raceway 49 in first end ring bearing 46. As illustrated in FIGS. 5 and 6, yoke 56 and its adjusting means 58, when slid along drive shaft 54, results in movement of first end ring bearing 46 and first adjusting rod 28 contained therein. This movement results in adjustment of the angle of the blades 24 in relation to the axis of rotation of sleeve 20.

The trailing and leading edge blade pitch adjustment is provided by a second adjusting means 62. Trailing edge adjusting rod 42 is held within raceway 57 in second end ring bearing 48 for rotation therewith and leading edge adjusting rod 44 is held within raceway 59 in third end ring bearing 50 for rotation therewith. Upper finger 64 is held in raceway 51 in second end bearing 48 for adjustment of the trailing edge 38 of blades 24 and a lower finger 66 is held in raceway 53 in third end ring bearing 50 for adjustment of leading edge 40 of blades 24. Fingers 64 and 66 are pivotally attached to a linkage rod 68 which has a center pivot rod 70 attached to first adjusting means 58. An adjusting linkage 72 is pivotally attached to the upper end of linkage rod 68 for adjustment of second adjusting means 62.

In the embodiment illustrated center pivot rod 70 is attached between first adjusting means 58 and linkage rod 68 such that the distance between center pivot rod 70 and upper finger 64 is less than the distance between pivot rod 70 and lower finger 66. This results in a greater range of movement of the lower finger 66 than upper finger 64 and consequently greater range of movement for adjustment of the leading edge of the blade 24. The greater range of movement is required in order to provide for proper adjustment of the leading edge when the angle of attack of blade 24 is adjusted through first adjusting means 58 and first adjusting rod 28. The range of movement required is directly related to the distance of the point of attachment of the second and third adjusting rods 42 and 44 to the blade 24 in relation to the position of attachment of the first adjusting rod 28 to blade 24. Thus, as third adjusting rod 44 is attached to blade 24 at a greater distance from first adjusting rod 28 than the distance at which the second adjusting rod 42 is attached to the blade, a greater range of movement is required in adjusting rod 44 than that required for adjusting rod 42. By moving the center pivot rod 70, such that the distance between center pivot rod 70 and lower finger 66 is greater than the distance between pivot rod 70 and upper finger 68, a greater range of movement of lower finger 66 and consequently third adjusting rod 44 linked to finger 66 through the third end ring bearing 50 is provided.

The adjustment of leading edges 38 and trailing edges 40, of blades 24, is illustrated in FIG. 6. As the adjusting linkage 72 is moved rearwardly towards the propulsion apparatus 10, as shown by the arrow, the upper end of linkage rod 68 is also moved rearwardly, pivoting about center pivot 70 attached to first adjusting means 58. The pivoting of linkage rod 68 about the fixed center pivot rod 70, results in upper finger 64 attached to linkage rod 68 moving towards the apparatus 10, in turn moving second end ring bearing 48 and second adjusting rod 42 held within it, which results in trailing edge 38 of blade 24 moving about hinge 34 away from the center line of blade 30 which is held in place by first end ring bearing 46 and first adjusting rod 28. At the same time lower finger 66 moves forwardly away from the apparatus 10 in turn moving third end ring bearing 48 and its attached adjusting rod 44, which results in leading edge 40 of blades 24 moving about hinge 36, away from the center line of blades 24, in a direction opposite to that of the trailing edge 38. In this way the pitch of the individual blades is adjustable.

As shown in FIG. 5, by movement of the first adjusting means 58 in conjunction with the second adjustment means 62 for the leading and trailing edges of the propeller blades 24, both the angle of attack of the blade as well as the leading and trailing edges can be adjusted. In this way, the displacement of water by the individual propeller blades 24 is increased which in the case of marine applications, will result in an increased speed of the boat to which the propulsion apparatus is attached.

As shown in FIG. 6, if one wishes to reverse the direction of the thrust of the apparatus 10, first adjusting means 58 is moved away from the apparatus 10 and adjusting linkage 72 attached to second adjusting means 62 adjusting the leading edge 40 and trailing edge 38 is also moved away. In this way, the propulsion of the water through the turbine propeller apparatus is reversed.

In operation, the driving mechanism (not shown) is attached to drive shaft 54 and is operated to rotate drive gear 52 at a desired rate of revolution. Ring gear 16 is rotated by the belt 17 which in turn rotates the sleeve 20 and the attached blades 24 at a relatively constant rate of revolution. To provide initial forward or reverse motion of the boat, the leading and trailing edges 40 and 38 of the blades 24 are moved from the center line of the blade as described hereinabove. Once the boat has started moving in the desired direction, the speed of the boat is regulated by adjustment of the angle of attack of the blades 24 as described hereinabove and by the speed of the driving mechanism. During acceleration of the boat through adjustment of the angle of attack of the blades 24, it may be desirable to trim the pitch of the blades which may be easily accomplished by adjustment of the leading and trailing edges 40 and 38. Thus with the apparatus of the present invention, forward and reverse speed of propulsion is not dependent on engine speed since adjustment of the blades 24 at a fixed engine speed can accelerate or decelerate the propulsion effort.

In a fixed attachment, pressure from the outlet of the apparatus 10 can be applied to a rudder and power can be supplied from a traditional propeller shaft. Since there are many different hull configurations attachment to the hull is effected using brackets 18 attached to the outer casing 12 and fastening those brackets to the hull of the vessel. This attachment can be used for inboard engines of any size which in turn power exterior projecting propeller shafts.

For outboard use the apparatus 10 can be designed into the lower drive casing of the typical (portable or otherwise) outboard motor.

For inboard/outboard units where the propulsion unit protrudes directly beneath the motor and outside the hull line or where the engine is an inboard and the propulsion unit is external in a horizontal alignment, the propulsion assembly 10 can be designed to be attached similar to that of the standard outboard.

In certain applications the propulsion assembly 10 can be pivoted to provide a power and steering mechanism. The drive would embody a tapered gear driving a circular gear as found in an automotive differential. A further development could include subsurface vessel utilization.

The apparatus of the present invention also has utility in applications other than as replacement of traditional marine propeller apparatus. For example, the propulsion apparatus 10 could be modified and fitted in line within a pipeline to provide a pumping action for movement of a liquid along the pipeline. In such a situation, the individual blades could be fixed at a particular angle and pitch adjustment and may not require the use of the various adjusting means.

Similarly, propulsion apparatus 10 could be modified and fitted in line within a pipeline through which a liquid is travelling at a velocity. In such a situation the propulsion apparatus will provide a mechanical powered take-off function and thus could be used for example to drive a simple compact electric generator or tool.

The embodiment illustrated has blades 24 as generally C-shaped mounted at their bottom to the sleeve 20. Blades 24 can be of other shapes provided that they allow for angular adjustment of the blades and free movement of the leading and trailing edges of the blades as described hereinabove. Thus the opening of the C-shape of the blades 24 can be reduced so long as the leading and trailing edges 40 and 38 move freely past one another during their operation described above. Blades 24 may also be attached to sleeve 20 at other points on their periphery, as for example at the midpoint of the blade. In such cases the positioning of the various adjusting rods may have to be varied to provide for optimum adjustability of the blades 24.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A propulsion apparatus for fluid medium comprising:

an open-ended sleeve having an inlet and outlet for flow through of fluid, said sleeve being rotatably attached to a drive means;

a series of blades positioned within and along said sleeve, each of said blades having a leading and trailing edge and each of said blades being attached to said sleeve for rotation therewith;

said blades cooperating to define a fluid path to accelerate a fluid from said inlet to said outlet to thereby provide thrust for propulsion as said sleeve is rotated;

adjusting means interconnecting said blades for pitch adjustment of said leading and trailing edges of said blades.

2. A propulsion apparatus as claimed in claim 1 wherein said blades are generally C shaped thereby defining a central opening through said sleeve between said inlet and said outlet and an interrupted helical like path for the fluid passing over said blades as said sleeve is rotated.

3. A propulsion apparatus as claimed in claim 2 wherein said central opening is progressively reduced from said inlet to said outlet.

4. A propulsion apparatus as claimed in claim 3 wherein said blades are pivotally attached at their periphery to said sleeve.

5. A propulsion apparatus as claimed in claim 4 further comprising first adjusting means interconnecting said blades for angular adjustment of said blades.

6. A propulsion apparatus for fluid medium comprising:

an open-ended sleeve having an inlet and outlet for flow through of fluid, said sleeve being rotatably attached to a drive means;

a series of blades positioned within and along said sleeve, each of said blades having a leading and trailing edge and each of said blades being pivotally attached at their periphery to said sleeve for rotation therewith;

said blades cooperating to define a fluid path to accelerate a fluid from said inlet to said outlet to thereby provide thrust for propulsion as said sleeve is rotated;

first adjusting means interconnecting said blades for angular adjustment of said blades;

second and third adjusting means interconnecting said blades for pitch adjustment of said leading and trailing edges of said blades.

7. A propulsion apparatus for use in a fluid medium comprising:

an open-ended sleeve having an inlet and outlet for flow through of fluid, said sleeve being rotatably mounted within a casing and attached to a drive means;

a series of blades positioned one behind the other along said sleeve, each of said blades having adjustable leading and trailing edges and each of said blades being attached to said sleeve for rotation therewith;

first adjusting means interconnecting said blades for angular adjustment of said blades;

second and third adjusting means interconnecting said blades for adjustment of the pitch of said leading and trailing edges of said blades;

said first, second and third adjusting means cooperating whereby the adjustment of the pitch of the leading and trailing edges of said blades, in conjunction with the angular adjustment of said blade, allows for both forward or reverse thrust independent of the direction or speed of rotation of said drive means.

* * * * *